US005231890A

United States Patent [19]

Hayasaka

[11] Patent Number: 5,231,890

[45] Date of Patent: Aug. 3, 1993

[54] SHIFTING SYSTEM FOR OUTBOARD DRIVE UNIT

[75] Inventor: Kenichi Hayasaka, Hamamatsu, Japan

[73] Assignee: Yamaha Hatsudoki Kabushiki Kaisha, Iwata, Japan

[21] Appl. No.: 896,232

[22] Filed: Jun. 10, 1992

[30] Foreign Application Priority Data

Jun. 10, 1991 [JP] Japan ..... 3-163314

[51] Int. Cl.[5] ..... B63H 5/13

[52] U.S. Cl. ..... 74/501.6; 440/75; 440/86

[58] Field of Search ..... 74/501.6, ; 440/75, 440/86

[56] References Cited

U.S. PATENT DOCUMENTS

| | | | |
|---|---|---|---|
| 1,318,184 | 10/1919 | Siren | 74/501.6 X |
| 1,964,383 | 6/1934 | Goodyear et al. | 74/501.6 X |
| 3,583,506 | 6/1971 | Preble | 74/501.6 X |
| 4,195,466 | 4/1980 | Heismann | 74/501.6 X |
| 4,493,224 | 1/1985 | Speelman | 74/501.6 X |
| 4,637,802 | 1/1987 | Taguchi et al. | 74/378 X |
| 4,753,618 | 6/1988 | Entringer | 440/86 |
| 4,755,156 | 7/1988 | Wagner | 440/86 |
| 4,924,724 | 5/1990 | Yoshimura | 74/501.6 X |
| 4,927,391 | 5/1990 | Bland et al. | 440/75 |
| 4,973,274 | 11/1990 | Hirukawa | 74/851 X |

FOREIGN PATENT DOCUMENTS

| | | | |
|---|---|---|---|
| 763819 | 5/1934 | France | 74/501.6 |
| 1027452 | 5/1953 | France | 74/501.6 |
| 63-137098 | 6/1988 | Japan . | |
| 742261 | 7/1980 | U.S.S.R. | 440/86 |
| 2168022 | 6/1986 | United Kingdom | 440/86 |

*Primary Examiner*—Rodney H. Bonck
*Assistant Examiner*—Ryan W. Massey
*Attorney, Agent, or Firm*—Ernest A. Beutler

[57] ABSTRACT

A shifting system for an outboard drive unit comprised of a shift mechanism that is interposed between a remote operator and a controlled member associated with the transmission of the drive unit. An input cable having an inner wire and outer sheath interconnects the operator with the shift mechanism while an output cable of the same structure interconnects the shift mechanism with the controlled member. The shift mechanism includes a lever which has three inner wire connecting portions and which is pivotally mounted on a base that includes a pair of connecting portions for the outer cables. The connection points of the inner wires and outer cables are selectively changed to accommodate different types of transmission selectors and drive units with normal or reverse rotation propellers.

18 Claims, 7 Drawing Sheets

SHIFTING SYSTEM FOR OUTBOARD DRIVE UNIT

BACKGROUND OF THE INVENTION

This invention relates to a shifting system, and more particularly to an improved, compact shifting system for an outboard drive unit which employs a remote operator for controlling a clutch actuator, and a shift lever that is interposed between the operator and the clutch actuator and between two interconnecting shift cables which can be changed to different connection points on the lever to accommodate different types of drive unit equipment.

A well known type of inboard/outboard drive unit includes an outdrive portion that is mounted on the rear of the transom of a watercraft for steering movement about a generally vertically extending axis and tilt and trim movement about a generally horizontally extending axis. A universal joint couples an output shaft of a hull mounted internal combustion engine to an input shaft of this outdrive. Conventionally, the outboard drive unit includes a bevel gear type of forward, neutral, reverse transmission mounted on the input shaft and which drives a driveshaft in selected forward or reverse directions. A clutch mechanism is incorporated for selectively coupling one or the other of the driving bevel gears with the input shaft so as to drive the driveshaft in the selected direction.

The clutch mechanism is operably connected to a remote operator for shifting the transmission in response to movement of the operator. The movement of the remote shift operator is typically transmitted to the clutch through a cable interconnecting these two components. The controlled member, in turn, actuates the clutch mechanism.

One type of shifting system for an outboard drive unit is set forth in Japanese Unexamined Patent Publication 63-137098. This shifting system is provided with a lever device disposed between the remote control operator and the transmission and connected with the operator and the transmission through separate control cables. By employing two separate control cables, this system offers the advantage of being able to replace only that segment of cable which is worn. Cable wear may occur sooner in areas of the cable(s) where there is bending which is sometimes required to accommodate hull structure of the associated watercraft or system design.

In connection with shifting systems, there are two types of remote control operator systems: a pull type and a push type. With the pull type system, the cable connected to the remote operator is pulled for forward shifting. With the push type system, the remote operator cable is pushed to achieve forward shifting.

There are also two types of outboard drive units either of which can be paired with either type of operator system. One is the normal rotation type wherein the propeller is rotated clockwise to advance the associated watercraft forward when the remote operator cable is pulled. Exerting a pushing force on the remote operator cable causes the propeller to turn in the counterclockwise direction for reverse operation. This normal rotation type of outboard drive unit utilizes a normal rotation propeller which advances the watercraft when rotated in the clockwise direction.

The other type of outboard drive unit is the reverse rotation type. With this type, when the operator cable is pulled, the propeller turns counterclockwise to advance the vessel forward. Conversely, when the operator cable is pushed, the propeller rotates in the clockwise direction for reverse operation of the vessel. A reverse rotation propeller, which advances the watercraft when it is rotated in the counter-clockwise direction, is employed on the reverse rotation type outboard drive unit.

Equipping the watercraft with the appropriate type of remote control system, and outboard drive unit and associated propeller can be relatively complicated and time consuming. Moreover, if the equipment is not correctly paired in accordance with system design during installation, either the remote control system or the propeller would need to be changed. Such modifications can be time consuming and costly.

Problems may also arise during use. This can occur, for example, when there is damage to the propeller on a normal rotation type drive unit that is connected with a pull type remote control system, but only a reverse rotation propeller is available as a spare part on board the watercraft or at a nearby marina.

It is, therefore, a principal object of this invention to provide an improved compact shifting system which is very versatile and which may be easily and readily employed in connection with different types of equipment.

It is a further object of this invention to provide a shifting system for an outboard drive unit which employs a member on the drive unit that is controlled in response to movement of a remote operator, and a shift lever that is interposed between the member and operator as well as between two interconnecting shift cables that can be changed to different connection points on the lever to accommodate different types of propellers and different types of remote control systems.

SUMMARY OF THE INVENTION

This invention is adapted to be embodied in a shifting system for actuating a controlled member, such as a transmission clutch actuator, comprising an operator movable between a plurality of positions and a shift mechanism including a base and a lever pivotally mounted on the base and having first and second arms extending outwardly from the pivot point of the lever. A first cable is connected at one end to the operator and is selectively connectible at the other end to one of a plurality of positions, at least one of the positions being on the first arm of the lever and at least one of the positions being on the second arm of the lever. A second cable is connected at one end to the controlled member and is selectively connectible at the other end to one of a plurality of positions, at least one of the positions being on the first arm of the lever and at least one of the positions being on the second arm of the lever.

This invention is also adapted to be embodied in a control assembly for transmitting movement from an operator in one direction to movement of a controlled member in either of two opposite directions through a control cable having a connection at one of its ends to the operator and a controlled cable having a connection at one of its ends to the controlled member. The control assembly comprises a base, a lever, means for connecting the lever to the base for pivotal movement of the lever relative to the base, means for connecting the other end of the control cable to the lever and means for connecting the other end of the controlled cable to the lever. In accordance with the invention, at least one of the connecting means is movable between a first position wherein movement of the operator in one direction effects movement of the controlled member in a first direction and a second position wherein movement of the operator in the one direction moves the controlled member in a second direction opposite to the first direction.

DETAILED DESCRIPTION OF THE PREFERRED EMBODIMENTS OF THE INVENTION

Figure 1:
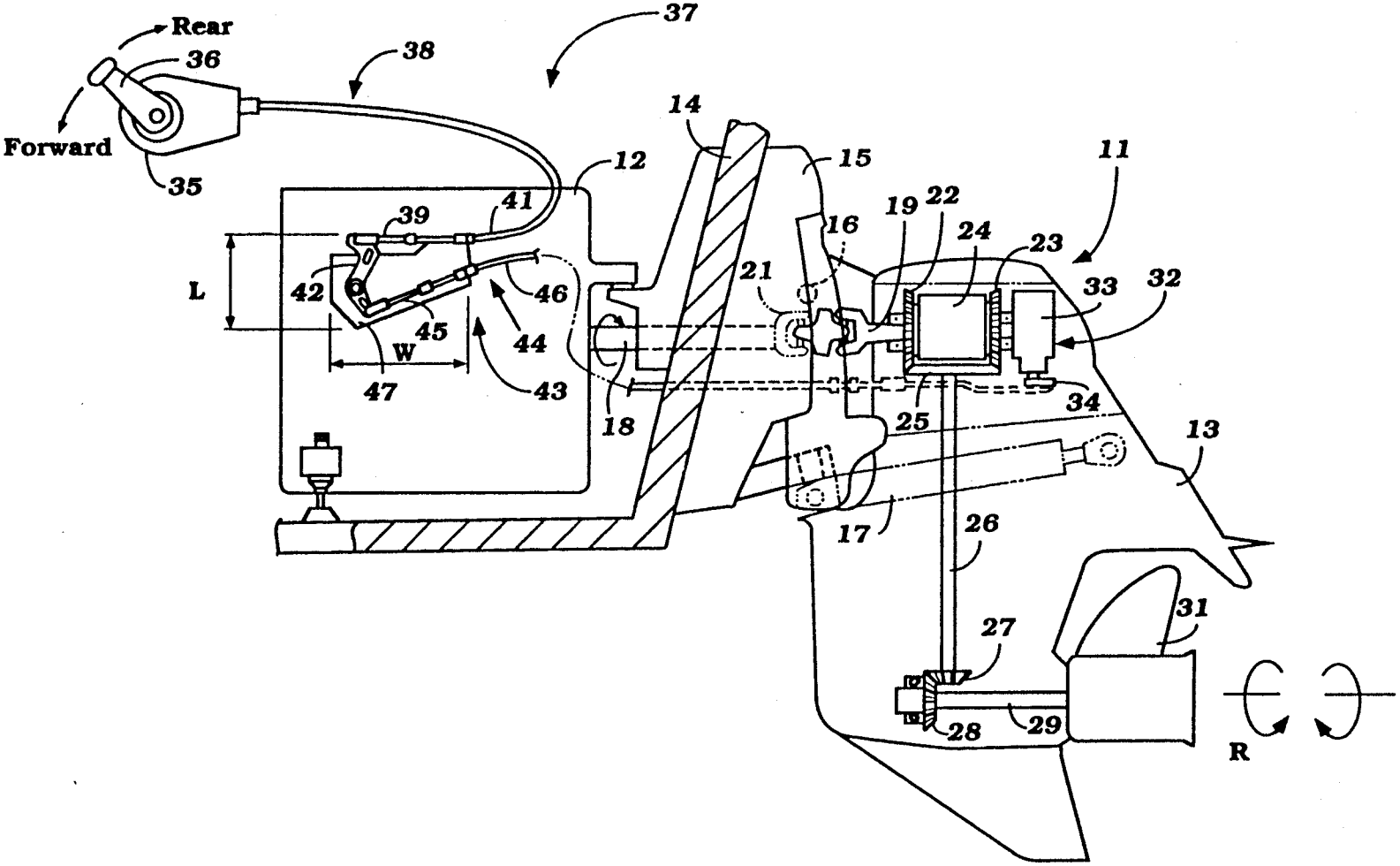
FIG. 1 is a side elevational view of a portion of an outboard drive unit having a shifting system constructed in accordance with an embodiment of the invention and attached to the transom of the marine vessel, shown partially and in cross-section.

Referring first to FIG. 1, an outboard drive unit is shown attached to the hull of an associated marine vessel and is identified generally by the reference numeral 11. The outboard drive unit 11 is, in the illustrated embodiment, of the inboard/outboard type consisting of an internal combustion engine 12 that is contained within the hull and an outdrive portion 13. Although the invention is described in conjunction with an inboard/outboard type of outboard drive unit, it will be understood by those skilled in the art that the invention can be utilized in connection with other types of outboard drive units, such as outboard motors per se. In addition, certain facets of the invention have application and uses other than marine applications.

The outdrive portion 13 is mounted on a gimbal ring for tilt and trim movement about a generally extending horizontal axis by means of tilt shafts 16. The gimbal ring is, in turn, mounted on a gimbal housing 15 for steering movement of the outdrive portion 13 about a generally vertically extending steering axis. A pair of linear fluid motors, identified by the reference numeral 17, are provided, one on each side of the outdrive portion 13 for effecting power tilt and trim movement of the outdrive 13.

The engine 12 drives an output shaft 18 which extends through an opening in the transom 14 and is coupled to an input shaft 19 of the outdrive portion 13 through a universal connection 21 so as to accommodate the steering and tilt and trim movement of the outdrive portion 13. The input shaft 19, in turn, drives a forward, neutral, reverse transmission which comprises a pair of driving bevel gears 22 and 23 that are journaled on the input shaft 19. A hydraulic clutch 24 is interposed between the driving bevel gears 22 and 23 and includes means for selectively engaging one or the other of the gears 22 or 23 with the input shaft 19 so as to rotate a driven bevel gear 25 that is affixed to the top of a driveshaft 26 in either the forward or reverse direction.

The driveshaft 26 is journaled for rotation within the outdrive portion 13 has affixed to its lower end a bevel gear 27 that drives a corresponding bevel gear 28 affixed to a propeller shaft 29. A propeller 31 is affixed to the propeller shaft 29 for propelling the marine vessel in selected forward or reverse directions.

To the rear portion of the input shaft 19 is connected a clutch operating unit identified generally by the reference numeral 32 and which includes a pressure pump (not shown) that is driven by the input shaft 19. The clutch operating unit 32 is enclosed in a housing 33 which has attached to its lower portion a shift lever 34 that is adapted to adjust a stem valve contained within the housing 33 in a manner to be described.

Positioned at an appropriate location within the hull of the marine vessel is a transmission selector 35 that is comprised of a shift operator 36 which is movable between a plurality of positions. The shift operator 36 is used to effect movement of the lever 34 to control the transmission of the outboard drive unit 11.

Figure 2:
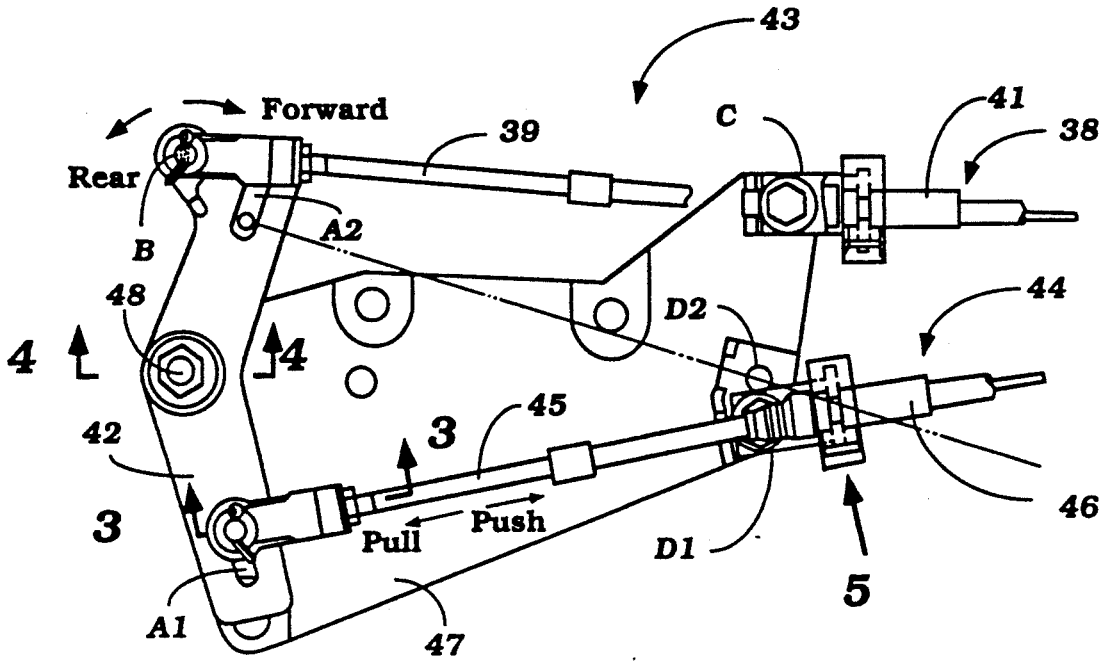
FIG. 2 is an, enlarged view showing the shift mechanism of FIG. 1.

Referring now to FIG. 2, in addition to FIG. 1, the operator 36 is embodied in a shifting system identified generally by the reference numeral 37. This shifting system 37 comprises an input cable identified generally by the reference numeral 38 that includes of a flexible transmitter 39 having one end connected to the operator 36. The flexible transmitter 39 is slidably supported in a protective sheath 41 and has its opposite end connected to a shift lever 42 of a shift mechanism, identified generally by the reference numeral 43. An output cable 44 includes a flexible wire transmitter 45 that is slidably movable within a protective sheath 46 and is connected at one end to the shift lever 42. The other end of the inner wire 45 is connected to the shift lever 34.

The shift lever 42 is pivotally supported on one side of a base 47 by means of a bolt 48 which divides the lever 42 into upper and lower segments or arms. The lever 42 is provided with three slot-like connecting portions for the inner wires 39 and 45. Two of the connecting portions identified in FIG. 2 by A1 and A2 are located on the lower and upper segments of the lever 42 respectively equidistant from the pivot point of the lever 42, while the connecting portion B is located on the upper segment at a distance from the pivot point greater than the distance of either A1 or A2. Three connecting portions are also provided on the side of the base 47 opposite the lever 42 for the outer cables 41 and 46. Outer cable connecting portion C on the upper right side of the base 47, as seen from FIG. 2, corresponds with the inner wire connecting portion B while the outer cable connecting portions D1 and D2 on the lower right side of the base 47 correspond with inner wire connecting portions A1 and A2 respectively.

This arrangement makes for a versatile yet compact shift mechanism 43. In particular, by positioning the connecting portions A1 and A2 closer to the pivot point than connecting portion B, the longitudinal size, denoted by the reference letter L in FIG. 1, can be minimized. Furthermore, since the inner input cable 38 is connected to connecting portion B and the inner output cable 45 is connected to connecting portion A1 or A2 having a shorter arm length, the cable stroke on the input side is longer than on the output side.

In the illustrated embodiment, the inner wire 39 of the input cable 38 is connected to the connecting portion B whereas the protective sheath 41 is connected to the connecting portion C. The inner wire 45 of the output cable 44 may be selectively connected to either connecting portion A1 or A2 depending on the type shift arrangement is desired. Similarly, outer sheath 46 may be selectively connected to either connecting portion D1, corresponding to connecting portion A1 for the inner wire 45, or D2 which corresponds to connecting portion A2 for the inner wire 45, depending on the arrangement employed.

Figure 3:
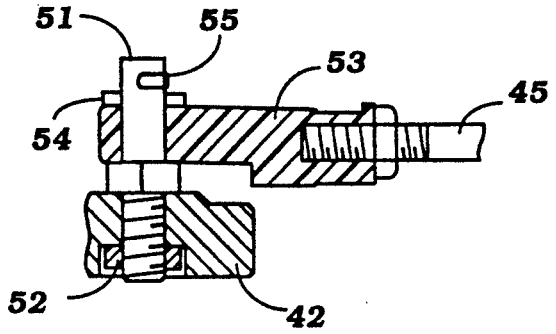
FIG. 3 is a cross-sectional view taken along line 3—3 of FIG. 2.

FIG. 3 illustrates the structure for connecting the inner wire 39 or 45 to the connecting portions A1, A2 and B of the lever 42. A pin 51 having a threaded portion is received within a corresponding bore on each of the connecting portions A1, A2 and B and is secured by means of a nut 52 that is positioned within a larger diameter portion of each bore. An elongated connector 53 is affixed at one end to the upper portion of the pin 51 and held in place by means of a washer 54 and check pin 55. The other end of the connector 53 has a threaded bore formed therein for threaded engagement with one end of the inner wire 39 or 45.

Figure 4:
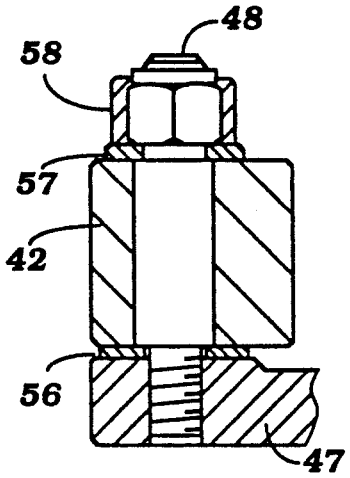
FIG. 4 a cross-sectional view taken along line 4—4 of FIG. 2.

The details of the connection of the lever 42 to the base 47 are shown in FIG. 4. A pair of washers 56 and 57, one 56 interposed between the lever 42 and base 47 and the other 57 interposed between the bolt head and the lever 42. A bolt cover 58 is fitted around the bolt 48.

Figure 5:
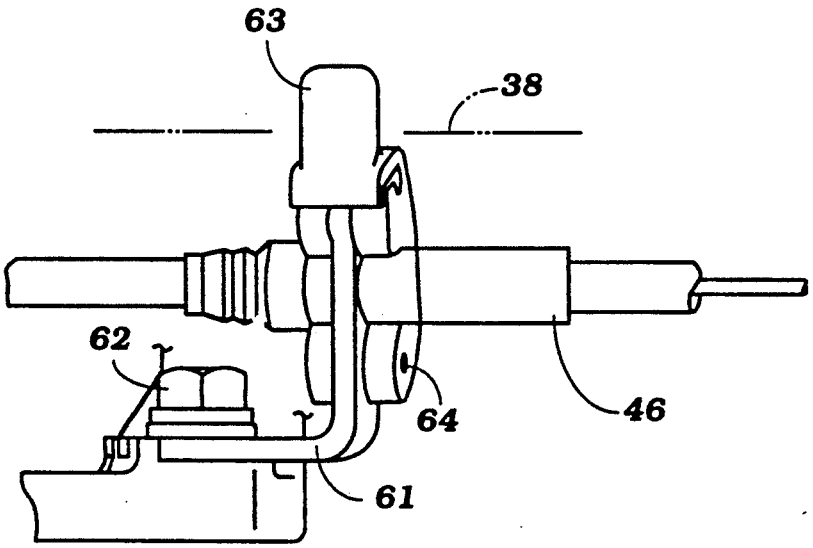
FIG. 5 is an enlarged view taken in the direction of the arrow 5 of FIG. 2.

FIG. 5 illustrates the structure for connecting the protective sheath 41 or 46 to the outer cable connecting portion C, D1 or D2 on the base 47 of the shift mechanism 43. A stay 61 is affixed on each of the connecting portions C, D1 and D2 through an associated bolt 62. A clamp lever 63 having a groove is pivotally mounted on each stay 61 by means of a pin 64 such that each clamp lever 63 may be pivoted to clamp the portion of the outer cable 41 or 46 held in the groove between the clamp lever 63 and the stay 61.

Figure 7:
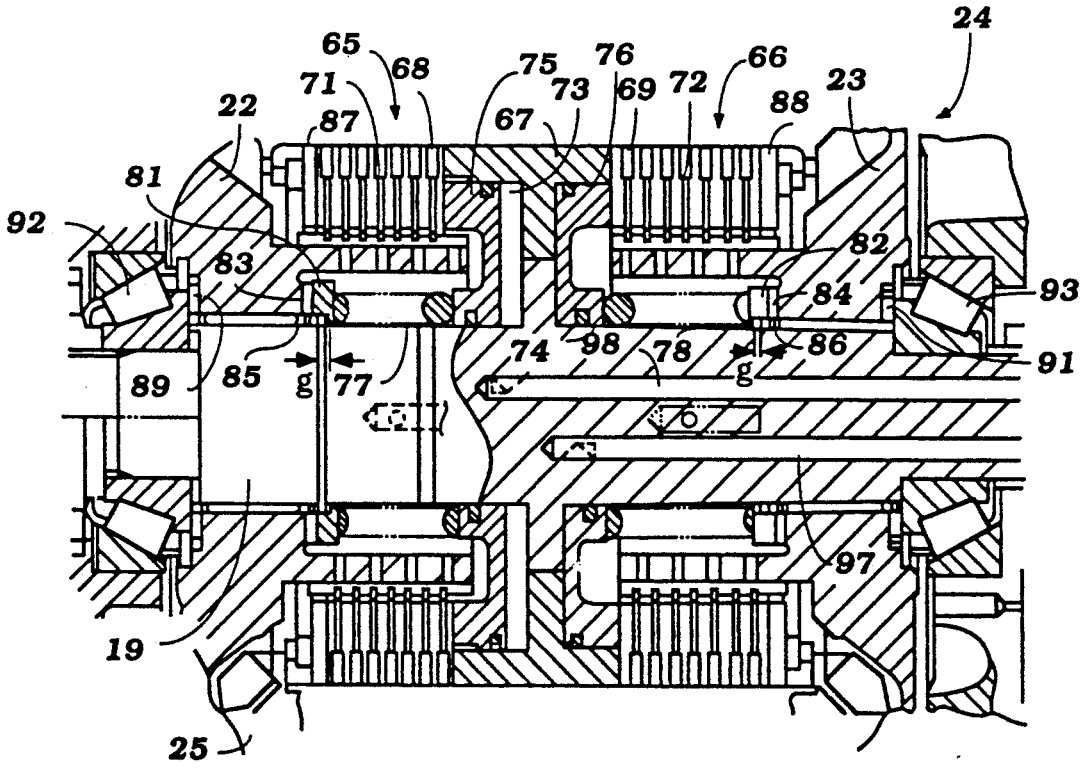
FIG. 7 is a cross-sectional view with portions broken away showing the hydraulic clutch of the transmission.

Referring now to FIG. 7, the clutch 24 is comprised of rotational multiple disc clutches 65 and 66 that are provided for selectively coupling a clutch housing 67, that is affixed such as by welding to the input shaft 19, to the gears 22 and 23 respectively, so as to drive the driveshaft 26 in forward and reverse directions, as aforenoted. The clutches 65 and 66 have a first series of plates 68 and 69 respectively that are externally splined and have a splined connection with the clutch housing 67 so as to rotate with it. These driving clutch plates 68 and 69 are alternated with driven clutch plates 71 and 72 respectively that have an internal splined connection to the hubs of the gears 22 and 23 respectively.

The clutch housing 67 defines a pair of oppositely facing bores 73 and 74 in which forward and reverse clutch actuating pistons 75 and 76 are slidably supported. The clutch plates 68 and 69 positioned on the innermost sides of the clutch housing 67 come into contact with the pistons 75 and 76 respectively, while the clutch plates 71 and 72 positioned on the outermost sides of the clutch housing 67 come into contact with pressure plates 87 and 88 respectively that are fixed on the clutch housing 67.

The pistons 75 and 76 are normally urged to a retracted position by means of respective release springs 77 and 78 that act between the pistons 75 and 76 and respective thrust washers 81 and 82 which are backed up by corresponding thrust bearings 83 and 84 on the inside of the driving bevel gears 22 and 23.

When the clutch assembly 24 is initially assembled on the input shaft 19 but before the bevel gears 22 and 23 are assembled on the input shaft 19, the return springs 77 and 78 and corresponding thrust washers 81 and 82 are held in place through retainer rings 85 and 86 respectively that are affixed on the input shaft 19. After complete assembly, the thrust washers 81 and 82 are pushed further into the clutch housing 67 against their respective return spring 77 and 78 by the gears 22 and 23 and thrust bearings 83 and 84 to form a gap (g) as illustrated in FIG. 7 between the thrust washers 81 and 82 and the corresponding retainer rings 85 and 86.

The outer sides of the driving bevel gears 22 and 23 are also engaged with thrust bearings 89 and 91 respectively which act against the inner races of corresponding front thrust bearings 92 and 93 so as to withstand the outward axial thrusts exerted on these driving bevel gears 22 and 23 during operation.

The piston chambers 73 and 74 are selectively pressurized by means of the clutch operating unit 32 which is mounted to the rear of the clutch 27 on the input shaft 19, as previously noted. The clutch operating unit 32 includes a pressure pump (not shown) that is made up of a pair of intermeshing gears, one of which has a keyed connection to the rear end of the input shaft 19 to be driven thereby. This gear pump draws lubricant from a reservoir formed in the lower portion of the outdrive 13 through a delivery passageway that runs generally parallel to the driveshaft 26. The pressurized fluid is then delivered at a regulated pressure to a control valve assembly, indicated by the reference numeral 94 and illustrated in FIGS. 6(A), 6(B) and 6(C). The pressurized lubricant is then delivered to various components of the system including the bevel gears 22 and 23 and then returned to the reservoir through a return passageway for eventual recirculation. The control valve 94 is also used to selectively pressurize either of the bores 73 or 74 to cause movement of the corresponding piston 75 or 76 for engaging either the clutch 65 or 66 for rotation with the input shaft 19.

Figure 6:
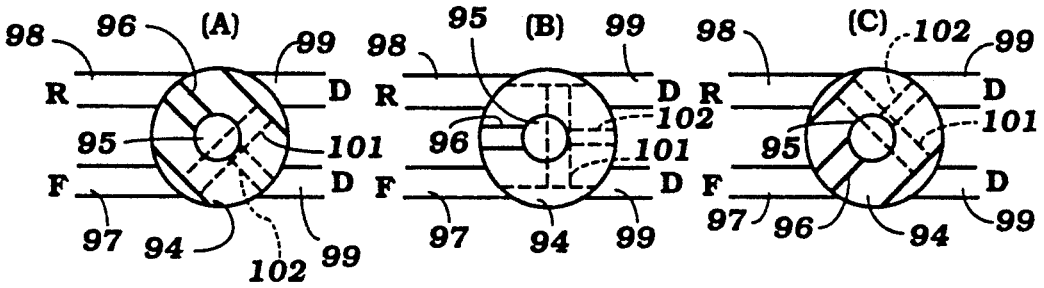
FIGS. 6(A), (B) and (C) respectively show the stem valve of the transmission in the reverse, neutral and forward shifting states respectively.

Referring now more specifically to FIGS. 6(A), 6(B) and 6(C), the valve 94 is, in the illustrated embodiments, of the rotating plug valve type and is rotatably journaled in an enlarged diameter cylindrical bore formed in the housing 33. The valve 94 has a reduced stem portion that extends through the lower portion of the housing 33 and which has the shift actuating lever 34 affixed to it for rotating the valve member 94 in response to movement of the shift operator 36. An axially extending port 95 is formed in the valve 94 and communicates with the upper end of the bore for receiving hydraulic fluid from a supply port that intersects the upper end of the bore. The port 95 terminates at its lower end with a radially extending passage 96.

As may be seen from FIGS. 6(A), 6(B) and 6(C), rotation of the valve 94 will selectively communicate the passage 96 and hence the supply port with a clutch line 97 (FIG. 6(C)), with neither the clutch line 97 nor a clutch line 98 (FIG. 6(B)) or with the clutch line 98 (FIG. 6(A)). The conduits 97 and 98 extend to the chambers 73 and 74 of the clutches 65 and 66, respectively. The lines 97 and 98 may be conveniently formed by drilling through the interior of the input shaft 19 and intersecting the drilled passages with radial passages.

To the back sides of the clutch pistons 75 and 76 are provided drain lines 99 that extend back to the reservoir through suitable internal passages so as to relieve the pressure on the back sides of the pistons 75 and 76 when they are actuated.

FIG. 6(C) shows the position of the valve 94 wherein it is positioned so as to expose the clutch line 97 to the pressure supply line through passage 96 and the clutch line 98 to the drain line 99 through one of a pair of flattened reliefs provided on diametrically opposite sides of the valve 94. When this occurs, the clutch 65 is engaged to engage driving bevel gear 22 with the input shaft 19 to drive the propeller shaft 29 and propeller 31 in the clockwise direction, while the clutch 66 is released. This normally corresponds to the forward shift state.

When the valve 94 is rotated to the position shown in FIG. 6(A), the valve 94 is positioned so that the clutch line 98 is communicated with the pressure supply line through passage 96 and the clutch line 97 is communicated with the drain line 99. This causes the clutch 66 to be engaged which, in turn, will engage driving bevel gear 23 with the input shaft 19 to drive the propeller 31 in the counterclockwise direction, while clutch 65 is released. This normally corresponds to the reverse shift state.

When the transmission is shifted into neutral by moving the selector valve 94 to the position shown in FIG. 6(B), both clutch lines 97 and 98 are connected to the drain line 99 through the flattened reliefs which are communicated with each other by a cross passage 101. In this case, neither clutch 65 nor 66 is engaged and the same is true for the driving bevel gears 22 and 23.

In addition to the supply passage 96, the valve member 94 is provided with a pair of smaller diameter cross drilled, axially spaced reaction ports 102 which extend at 180° from the supply port 96. The ports 102 are disposed so that they will not register with either of the clutch ports 97 or 98 nor the drain ports 82 regardless of the position of the valve member 94. As a result, fluid pressure that is applied through the supply port 96 will be balanced by the fluid pressure acting through the reaction ports 102 so as to ensure against any unbalanced radial forces acting on the valve member 94 which would resist its rotation.

It should be noted that when normal rotation equipment is used, the propeller 31 will rotate in the clockwise direction as seen from behind for forward movement of the marine vessel, whereas the propeller 31 will rotate in the counterclockwise direction as seen from behind for reverse movement. Conversely, when reverse rotation equipment is employed, rotation of the propeller 31 in the counterclockwise direction will cause forward movement of the vessel while rotation of the propeller 31 in the clockwise direction will cause reverse movement as seen from behind.

The operation of the shifting system 37 utilizing a pull type of transmission selector 35 wherein the inner cable 39 is pulled by moving the operator 36 forwardly to shift the transmission into forward will now be described. When the inner cable 45 of the output cable 44 is connected to the connecting portion A1 of the lever 42, the inner cable 45 is also pulled when the inner wire 39 is pulled, thereby causing the valve 94 to rotate to the position shown in FIG. 6(C). In this state, the propeller 31 rotates clockwise through engagement of clutch 65 and corresponding driving bevel gear 22, driven gear 25 and the gears 27 and 28. Therefore, if the drive unit 11 is of the normal rotation type having a normal rotation propeller 31 which advances the marine vessel when turning in the clockwise direction, the vessel is brought into the forward advancing state when the inner cable 39 is pulled.

When the operator 36 is moved rearwardly to exert a pushing movement on inner cables 39 and 45, the valve 94 is moved to the position shown in FIG. 6(A) causing the propeller 31 to rotate in the counterclockwise direction through the engagement of clutch 66 and gear 23 so as to bring the vessel into the reverse state when the drive unit 11 and propeller 31 are of the normal rotation type.

In the case where the inner wire 45 is connected to connecting portion A2 on the lever 42, the wire 45 is pushed when the wire 39 is pulled by forward movement of the operator 36. This causes the valve 94 to move into its reverse position as shown in FIG. 6(A) to engage driving gear 23 to cause the propeller 31 to turn counterclockwise. Therefore, if a normal rotation propeller 31 is used, control movement of the operator 36 will be exactly opposite its control movement if the inner wire 45 was connected to A1.

However, when inner wire 45 is connected to connecting portion A2 and a reverse rotation type of drive unit 11 and propeller 31 is used which advances the vessel forwardly upon counterclockwise rotation, the vessel is brought into its forward advancing state when the operator 36 is moved forwardly to pull inner wire 39; however, this is accomplished through engagement of clutch 66 and gear 23. Movement of the operator 36 rearwardly will cause opposite movements of the corresponding parts and bring the vessel into its reverse movement state through engagement of clutch 65 and gear 22.

Thus, by changing the connection point of the inner wire 45 to the lever 42 between A1 and A2, the direction of movement of the operator 36 for achieving forward movement of the vessel can be changed. Therefore, transmission selectors 35 of either the pull or push type can be used with drive units 11 and propellers 31 of either the normal or reverse rotation type. This makes the shifting system 37 much more versatile which is particularly advantageous if repair parts are needed.

If a push type of transmission selector 35 is used, forward movement of the operator 36 exerts a pushing movement on inner wire 39 and rearward movement of the operator 36 pulls the inner wire 39. Depending on the connection point of inner wire 45 to the lever 42, it will either be pulled to cause the propeller 31 to turn clockwise or it will be pushed in which case the propeller 31 will rotate counterclockwise. Whether this brings the marine vessel into its forward or reverse state will depend on the type of drive unit 11 and associated propeller 31 that is employed as set forth above.

Figure 8:
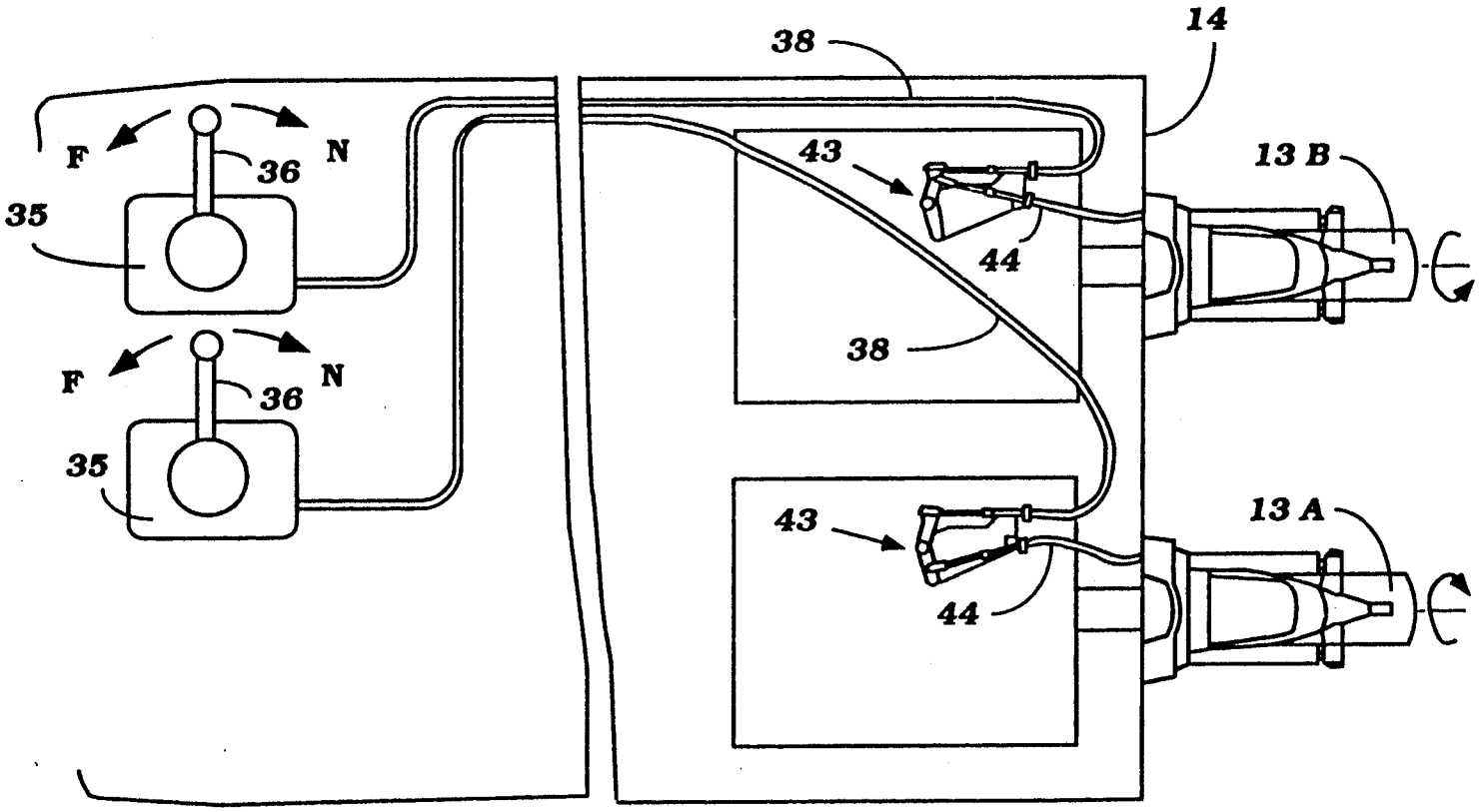
FIG. 8 is a top plan view showing a shifting system constructed in accordance with embodiments of the invention and incorporated in a marine vessel having two outboard drive units.

Referring now to FIG. 8, a marine vessel is depicted which has two outboard drive units 11 mounted on the port and starboard sides of the transom 14. These drive units 11 are paired to individual shifting systems 37 and are constructed in accordance with the above described embodiment of this invention. The port system functions as described above when the inner wire 45 is connected to A1. On the other hand, the starboard system functions as described above when the inner wire 45 is connected to A2. Accordingly, in the illustrated arrangement, a normal rotation type outboard drive unit 11 and propeller 31 is used on the port side while a reverse rotation type outboard drive unit 11 and propeller 31 is used on the starboard side so that operators 36 will have synchronized movement. Pull type transmission selectors 35 are preferably employed for both units.

Figure 9:
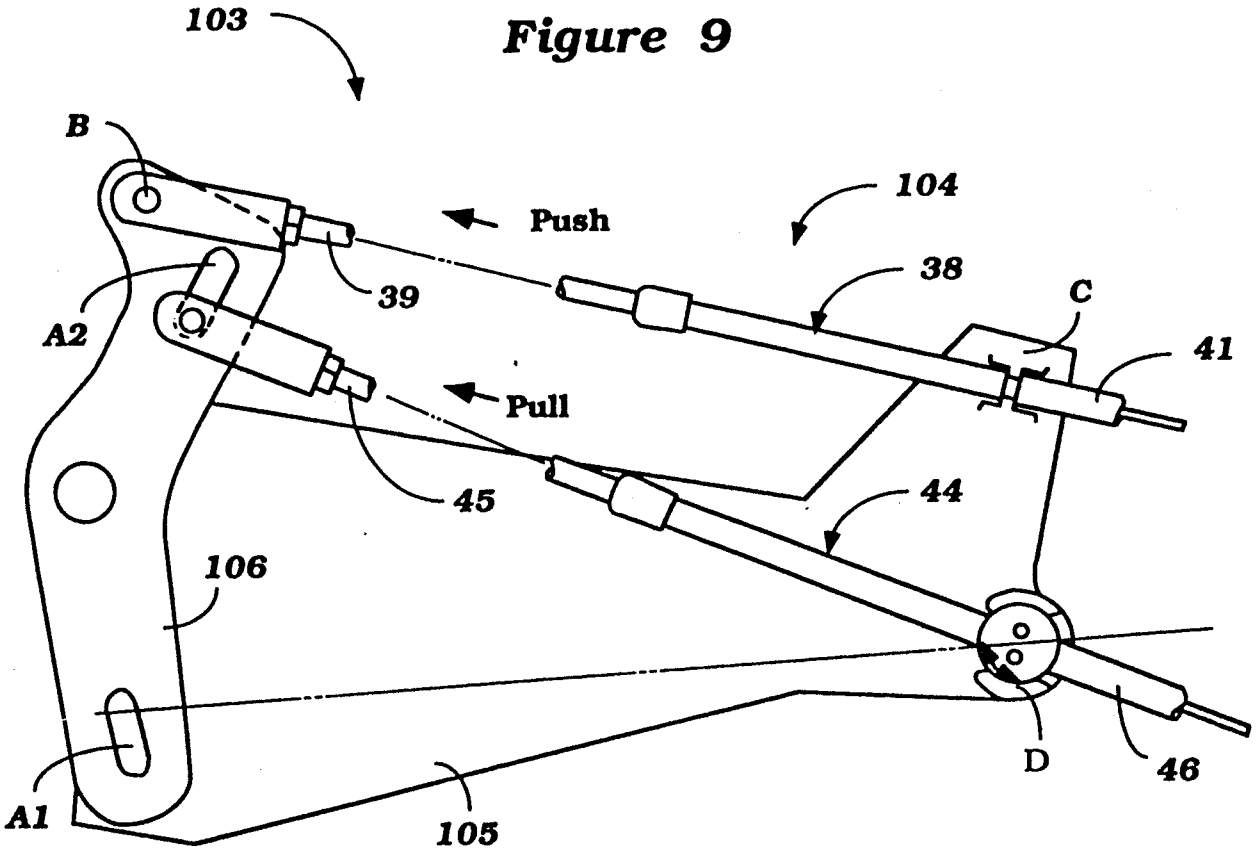
FIG. 9 is an enlarged side elevational view of the shifting mechanism and its lever illustrating a second embodiment of the invention.

A second embodiment of the shifting system is shown in FIG. 9 and is identified generally by the reference numeral 103. This shifting system 103 includes a shift mechanism identified generally by the reference numeral 104 which includes a base member 105 on which a shift lever 106 is pivotally mounted. As in the first embodiment, the lever 106 is provided with connecting portions A1 and A2 for inner cable 45. These connecting portions A1 and A2 are approximately equidistant from the pivot point of the lever 106. The lever 106 also includes a connecting portion B whose distance from the pivot point of the lever 106 is greater than the distance of either the connecting portion A1 or A2 from the pivot point. A connecting portion C is provided on the base 105 which corresponds to the connecting portion B on the lever 106. The base 105 further includes a connecting portion D which may correspond with either the connection portion A1 or A2 on the lever 106, depending on where the inner cable 45 is connected. These connecting portions C and D securely hold the outer cables 41 and 46 respectively in place.

In this embodiment, however, the connecting portion D is rotatably supported on the base 105 so as to facilitate connection of the inner wire 45 to either of the connecting portions A1 or A2 on the lever 106. Therefore, when the inner cable 45 is changed between connection points A and B, it is not necessary to disconnect the protective sheath 46 from the connecting portion D.

The operation of this shift mechanism 104 is the same as the operation described for the shift mechanism 43 in the first embodiment of this invention.

Figure 10:
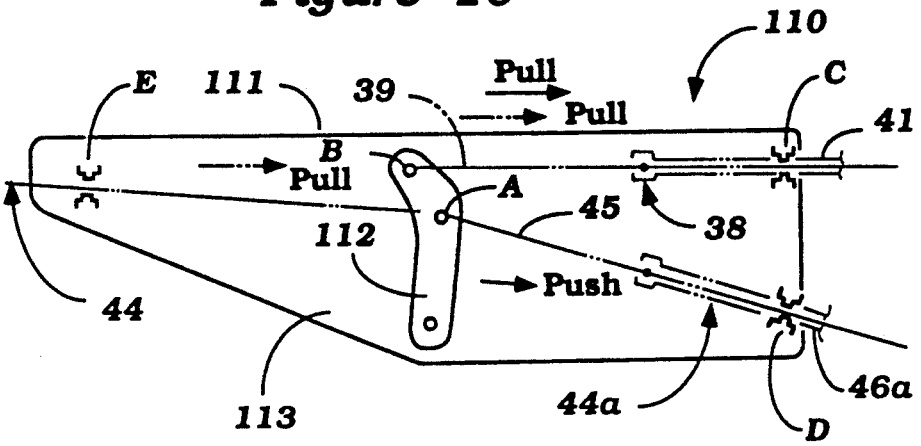
FIG. 10 is a side view of the shift mechanism including its lever showing a third embodiment of the invention.

A third embodiment of this invention is illustrated in FIG. 10. This third embodiment includes a shifting system identified generally by the reference numeral 110 that includes a shifting mechanism 111. A shift lever 112 has a bottom portion wherein it is pivotally mounted on a base member 113. The shift lever 112 has connecting portions B and A for inner wires 39 and 45 respectively and positioned at different distances from the pivot point of the lever 112. Connecting portion C on the base 113 holds protective sheath 41 in place while the protective sheath 46 may be attached to the base 113 at either connecting portion D or E. By changing the connection point of the protective sheath 46 of the output cable 44 from one side of the lever 112 to the other, the type of movement of its associated inner wire 45 of output cable 44 may be changed from pulling to pushing for a given type of movement of inner wire 39 of the input cable 38. Thus, this system 110 will also accommodate different types of transmission selectors 35 and propellers 31. This arrangement also allows for a more compact shifting mechanism 111 in the longitudinal direction.

Figure 11:
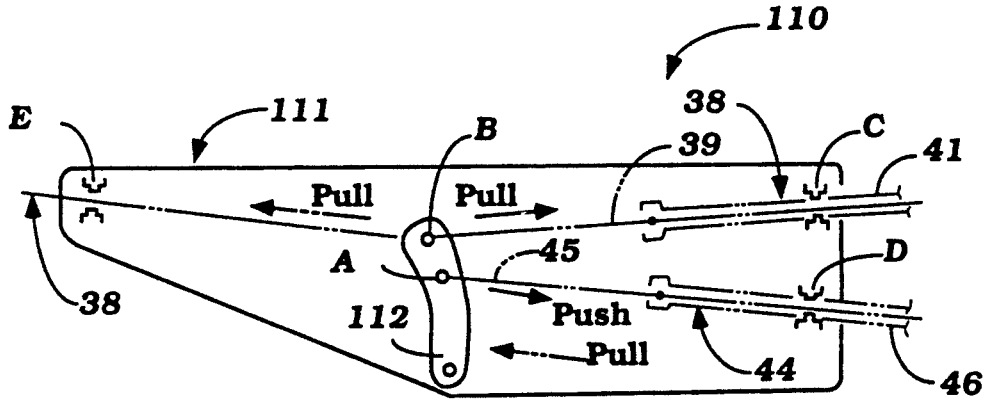
FIG. 11 is a side view of the shift mechanism including its lever showing a fourth embodiment of the invention.

FIG. 11 shows a fourth embodiment of the invention which is generally similar to the third embodiment. Here, however, it is the outer cable 41 which may be selectively connected to either connecting portion C or E while the outer cable 46 is attached at connecting portion D. Thus, the type of movement of inner wire 39 of input cable 38 may be changed from pulling to pushing for a given type of movement of inner wire 45 of the output cable 44 to accommodate different types of equipment.

It should be readily apparent from the foregoing description that several embodiments of a very versatile and compact shifting system for an outboard drive unit has been illustrated and described. Although several embodiments have been illustrated and described, various changes and modifications may be made without departing from the spirit and scope of the invention, as defined by the appended claims.

I claim:

1. A shifting system for actuating a controlled member, comprising an operator moveable between a plurality of positions and a shift mechanism including a base and a lever pivotally mounted on said base and having first and second arms extending outwardly from the pivot point of said lever, a first cable connected at one end to said operator and selectively connectible at the other end to one of a first plurality of positions, at least one of the positions being on the first arm of said lever and at least one of the positions being on the second arm of said lever, and a second cable connected at one end to said controlled member and selectively connectible at the other end to one of a second plurality of positions, at least one of the positions being on the first arm of said lever and at least one of the positions being on the second arm of said lever.

2. A shifting system as recited in claim 1, wherein said first cable comprises a first sheath and a first transmitter wire connected at one end to said operator and slidably supported in said first sheath and wherein said second cable comprises a second sheath and a second transmitter wire connected at one end to said controlled member and slidably supported in said second sheath.

3. A shifting system as recited in claim 2, wherein said first transmitter wire is selectively connectible at its other end to one of said first plurality of positions.

4. A shifting system as recited in claim 3, wherein said second transmitter wire is selectively connectible at its other end to one of said second plurality of positions.

5. A shifting system as recited in claim 1, wherein said controlled member comprises a valve.

6. A shifting system for actuating a controlled member, comprising an operator movable between a plurality of positions and a shift mechanism including a base and a lever pivotally mounted on said base and having first and second arms extending outwardly from the pivot point of said lever, a first cable connected at one end to said operator and connected at the other end to the first arm of said lever, and a second cable connected at one end to said controlled member and selectively connectible at the other end to one of two positions, one being on the first arm of said lever and the other being on the second arm of said lever.

7. A shifting system as recited in claim 6, wherein said first cable comprises a first sheath and a first transmitter wire connected at one end to said operator and slidably supported in said first sheath, and wherein said second cable comprises a second sheath and a second transmitter wire connected at one end to said controlled member and slidably supported in said second sheath.

8. A shifting system as recited in claim 7, wherein said first transmitter wire is connected at its other end to the first arm of said lever and wherein said second transmitter wire is selectively connectible at its other end to one of said two positions.

9. A shifting system as recited in claim 6, wherein said controlled member comprises a valve.

10. A shifting system as recited in claim 8, wherein said first and second sheaths are each connected to said base.

11. A shifting system as recited in claim 10, wherein said second sheath is selectively connectible to said base at one of two positions.

12. A shifting system as recited in claim 10, wherein said second sheath is connected to said base by means of a pivotal connection.

13. A control assembly for transmitting movement from an operator in one direction to movement of a controlled member in either of two opposite directions through a control cable having a connection at one of its ends to said operator and a controlled cable having a connection at one of its ends to said controlled member, said assembly comprising a base, a lever, means for connecting said lever to said base for pivotal movement of said lever relative to said base, means for connecting the other end of said control cable to said lever, and means for connecting the other end of said controlled cable to said at least one of said means for connecting being selectable between a first position wherein movement of said operator in one direction effects movement of said controlled member in a first direction and a second position wherein movement of said operator in said one direction moves said controlled member in a second direction opposite to said first direction.

14. A control assembly as recited in claim 13, wherein said lever has first and second arms extending outwardly from the pivot point of said lever, and wherein the first position of said means for connecting the other end of said controlled cable being on the first arm of said lever and the second position of said means for connecting the other end of said controlled cable being on the second arm of said lever.

15. A control assembly as recited in claim 14, wherein said means for connecting the other end of said control cable to said lever is mounted on said first arm of said lever.

16. A control assembly as recited in claim 14, wherein said means for connecting the other end of said control cable to said lever is mounted on said second arm of said lever.

17. A control assembly as recited in claim 14, further comprising a first sheath in which said control cable is slideably supported and a second sheath in which said controlled cable is slideably supported.

18. A control assembly as recited in claim 17, wherein said control cable sheath is mounted on said base, said control assembly further comprising means, moveable between a first and second position, for mounting said controlled cable sheath to said base.

* * * * *

UNITED STATES PATENT AND TRADEMARK OFFICE

CERTIFICATE OF CORRECTION

PATENT NO. : 5,231,890

DATED : August 3, 1993

INVENTOR(S) : Kenichi Hayasaka

It is certified that error appears in the above-indentified patent and that said Letters Patent is hereby corrected as shown below:

Column 11, line 24, Claim 13, line 25, after "said" (1st occur.) insert --lever,--.

Signed and Sealed this

Seventh Day of June, 1994

*Attest:*

*Attesting Officer*

BRUCE LEHMAN

*Commissioner of Patents and Trademarks*